US009365942B2

(12) United States Patent
Tsai et al.

(10) Patent No.: US 9,365,942 B2
(45) Date of Patent: Jun. 14, 2016

(54) ELECTROLYTIC COPPER FOIL AND METHOD FOR PRODUCING THE SAME

(71) Applicant: Chang Chun Petrochemical Co., Ltd., Taipei (TW)

(72) Inventors: Chen-Ping Tsai, Taipei (TW); Kuei-Sen Cheng, Taipei (TW); Chyen-Fu Lin, Taipei (TW)

(73) Assignee: CHANG CHUN PETROCHEMICAL CO., LTD., Taipei (TW)

( * ) Notice: Subject to any disclaimer, the term of this patent is extended or adjusted under 35 U.S.C. 154(b) by 0 days.

(21) Appl. No.: 14/063,088

(22) Filed: Oct. 25, 2013

(65) Prior Publication Data

US 2014/0193660 A1 Jul. 10, 2014

(30) Foreign Application Priority Data

Jan. 7, 2013 (TW) ..... 102100388 A

(51) Int. Cl.
*B21C 37/00* (2006.01)
*C25D 1/04* (2006.01)
*C25D 3/38* (2006.01)

(52) U.S. Cl.
CPC .. *C25D 1/04* (2013.01); *C25D 3/38* (2013.01); *Y10T 428/12431* (2015.01)

(58) Field of Classification Search
CPC ..... C23C 4/02; H05K 3/384; F16C 33/12
USPC ..... 428/612, 687
See application file for complete search history.

(56) References Cited

U.S. PATENT DOCUMENTS

| | | | | |
|---|---|---|---|---|
| 5,421,985 | A * | 6/1995 | Clouser et al. | 205/77 |
| 5,431,803 | A * | 7/1995 | DiFranco et al. | 205/50 |
| 5,834,140 | A * | 11/1998 | Wolski et al. | 429/220 |
| 6,231,742 | B1 * | 5/2001 | Sano et al. | 205/50 |
| 7,789,976 | B2 * | 9/2010 | Sano et al. | 148/411 |
| 8,715,836 | B2 | 5/2014 | Dobashi et al. | |
| 8,722,199 | B2 * | 5/2014 | Matsuda | C25D 1/04 205/291 |
| 8,816,338 | B2 | 8/2014 | Matsuura et al. | |
| 2014/0017564 | A1 | 1/2014 | Suzuki et al. | |

OTHER PUBLICATIONS

Surface Roughness (JIS B 0601-2001); p. R3.
Surface Roughness (JIS B 0601(1994)); p. 2840.
Surface Roughness by Different Processing Methods (JIS B 0021(1984)); p. 1129-1130.
IPC-TM-650 Test Methods Manual; Surface Roughness and Profile of Metallic Foils(Contacting Stylus Technique) p. 1-2.

* cited by examiner

*Primary Examiner* — Daniel J Schleis
(74) *Attorney, Agent, or Firm* — Polsinelli PC

(57) ABSTRACT

An electrolytic copper foil is provided. The electrolytic copper foil has a shiny side and a matte side opposing to the shiny side, wherein the difference in roughness between the shiny side and the matte side is 0.5 μm or less. The electrolytic copper foil has a tensile strength of 45 kg/mm$^2$ or above, and is particularly suitable for applications in a lithium ion secondary battery.

12 Claims, 3 Drawing Sheets

ELECTROLYTIC COPPER FOIL AND METHOD FOR PRODUCING THE SAME

REFERENCE TO RELATED APPLICATION

This application claims foreign priority under 35 U.S.C. §119(a) to Patent Application No. 102100388, filed on Jan. 7, 2013, in the Intellectual Property Office of Ministry of Economic Affairs, Republic of China (Taiwan, R.O.C.), the entire content of which Patent Application is incorporated herein by reference.

FIELD OF THE INVENTION

The present invention relates to electrolytic copper foils and methods for producing the same, and more particularly, to an electrolytic copper foil with double-sided gloss suitable for use in a lithium ion secondary battery and a method for producing the same.

BACKGROUND OF RELATED ART

An electrolytic copper foil is produced by using an aqueous solution composed of sulfuric acid and copper sulfate as an electrolyte, a titanium plate coated by iridium or an oxide thereof as a dimensionally stable anode (DSA), a titanium drum as a cathode, applying a direct current between two electrodes to electrodeposit copper ions in the electrolyte on the titanium drum, and then stripping the electrolytic copper foil from the surface of the titanium drum and continuously winding for manufacturing. The side that the electrolytic copper foil contacts with the surface of the titanium drum is referred to as "shiny side (S side)," and the back side of the electrolytic copper foil is referred to as "matte side (M side)." Usually, the roughness of the S side of an electrolytic copper foil depends on the roughness of the surface of the titanium drum. Therefore, the roughness of the S side of the electrolytic copper foil is relatively consistent, whereas the roughness of the M side can be controlled by adjusting the conditions of the copper sulfate electrolyte.

The current copper sulfate electrolytes for producing electrolytic copper foils for use in lithium ion secondary batteries can be mainly classified into two major categories, and one of which is the so-called additives-containing system, i.e., to a copper sulfate electrolyte, adding organic additives such as gelatin, hydroxyethyl cellulose (HEC) or polyethylene glycol (PEG), capable of inhibiting electrodeposition of copper ions, and sulfur-containing compounds such as sodium 3-mercaptopropane sulphonate (MPS) and bis-(3-sodiumsulfopropyl disulfide (SPS), capable of refining crystalline particles. As such, the roughness of the M side of the electrolytic copper foil can be lowered, and thereby obtaining an electrolytic copper foil with double-sided gloss and having a structure containing fine crystalline particles. The electrolytic copper foil produced by this type of additives-containing electrolyte system has typically a tensile strength of less than 40 kg/mm$^2$. The other category is the so-called non-additives-containing system, i.e., no addition of any organic additives to a copper sulfate electrolyte. This type of non-additives-containing system is contrary to the additives-containing system. The lower the total content of the organics in the copper sulfate electrolyte, the higher the likelihood of obtaining a glossy electrolytic copper foil having low roughness at the M side and no abnormal protruded particles on the surface. Although no organic additives are added to the copper sulfate electrolyte obtained from the non-additives-containing system, the copper raw material used in the copper sulfate electrolyte are mainly derived from commercially available recycled copper wires. The surfaces of the copper wires contain grease or other organic substances, such that when the copper wires are dissolved in sulfuric acid, the electrolyte for producing an electrolytic copper foil would be filled with impurities like grease or organic impurities. The higher the content of the organic impurities, the higher the likelihood of generating an electrolytic copper foil having numerous abnormal protruded particles on the M side. Hence, no electrolytic copper foil having double-sided gloss is obtained.

Moreover, when the M side of an electrolytic copper foil has numerous abnormal protruded particles, the subsequent applications in the manufacture of electrolytic copper foil are usually problematic. For example, during a copper roughening treatment, the abnormal protruded particles on the M side easily induce point discharging, which cause the copper roughening particles to abnormally concentrate. Subsequently, when the copper clad laminate was formed by pressing the electrolytic copper foil, the residual copper which was formed due to incomplete etching can easily cause a short circuit. As a result, the yields of the downstream products are poor.

In order to reduce the impact of organic impurities on the M side and physical properties of the electrolytic copper foil generated by the non-additives-containing system, Japanese Patent number 3850155 and 2850321 of Nippon Denkai Ltd. disclose a method for removing organic impurities from a copper sulfate electrolyte. In the method, copper wires are pretreated prior to dissolution, by burning the surfaces of the copper wires under a temperature of from 600 to 900° C. for 30 to 60 minutes, and washing the surfaces of the copper wires by 100 g/L of an aqueous sulfuric acid solution to remove the organic impurities from the surfaces of the copper wires. On the other hand, an ozone-generating device is further used to degrade grease or organic impurities in the copper sulfate electrolyte obtained from the pretreated copper wires above, and using an activated carbon filtration device to remove the degraded products by adsorption. However, although the method can be used to effectively obtain a clean copper sulfate electrolyte, burning copper wires at a high temperature consumes a large amount of energy. Further, even though the surfaces of copper wires can be washed by a sulfuric acid aqueous solution to remove organic impurities, a small amount of copper can be similarly removed to cause copper loss. In addition, as ozone is gas, it does not retain in the copper sulfate electrolyte easily. Thus, the effectiveness of further degrading organic impurities using ozone is poor. Also, high concentrations of ozone brings hazard and safety concerns to human bodies.

Accordingly, the industry urgently needs to develop an electrolytic copper foil which is suitable for use in a lithium ion secondary battery having a high tensile strength, a high elongation rate after a heat treatment, low roughness at the M side, and an extremely small difference in roughness between the S side and the M side. Yet, the manufacture process of the electrolytic copper foil is simple and free of safety concerns without increasing the complexity of electrolytes.

SUMMARY OF THE INVENTION

The present invention provides an electrolytic copper foil having opposing shiny side (S side) and matte side (M side), wherein the difference in roughness (Rz) between the S side and the M side is 0.5 μm or lower. The M side of the electrolytic copper foil of the present invention has gloss of 60 or above, when it is at a light incident angle of 60°. The roughness of the S side and the M side of the electrolytic copper foil of the present invention is 1.6 μm or lower.

In a preferred embodiment of the present invention, the roughness of the S side and the M side of the present invention is 1.6 μm or lower. The S side and the M side of the present invention both have smooth surfaces, such that they are particularly suitable for use in a lithium ion secondary battery.

Moreover, the electrolytic copper foil of the present invention has a tensile strength of 45 kg/mm$^2$ or above, and an elongation rate of 12% or above after a heat treatment at 140° C. for 5 hours. The electrolytic copper foil of the present invention simultaneously has a high tensile strength and a high elongation rate, and is capable of achieving excellent properties, such as, low roughness at both sides and extremely small difference in roughness between both sides. Hence, the electrolytic copper foil of the present invention can be applied in a broad range of industries.

The present invention further provides a method for producing an electrolytic copper foil, including the steps of providing a hydrogen peroxide solution in a copper sulfate electrolyte to obtain an improved copper sulfate electrolyte; and performing an electrochemical reaction with the improved copper sulfate electrolyte to produce the electrolytic copper foil of the present invention. Further, in a preferred embodiment, the method of the present invention further includes, prior to performing the electrochemical reaction with the improved copper sulfate electrolyte, using activated carbon to filter the improved copper sulfate electrolyte.

In the present invention, the preparation of the copper sulfate electrolyte includes dissolving a copper raw material in sulfuric acid to obtain a copper sulfate electrolyte, and adding hydrogen peroxide to degrade impurities like grease or organic impurities contained in the copper sulfate electrolyte. Therefore, in the method of the present invention, materials from copper wastes (such as copper wires) can be directly dissolved in sulfuric acid to obtain a clean copper sulfate electrolyte, without subjecting to pretreatments of copper wires, such as burning or acid wash.

DETAILED DESCRIPTION OF THE PREFERRED EMBODIMENTS

Figure 1:
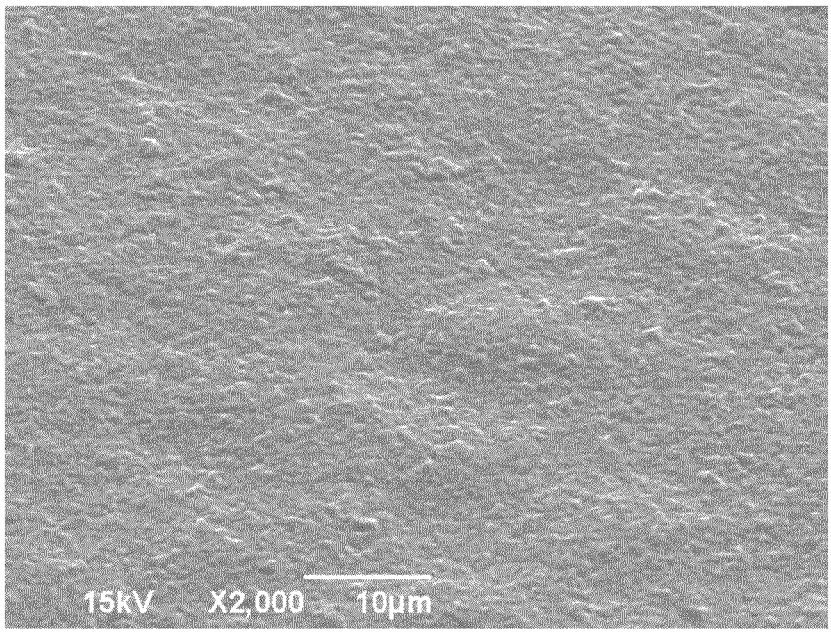
FIG. 1 is a photograph of the M side of the electrolytic copper foil of embodiment 1 of the present invention under electron microscopy at 2000× magnification.

The electrolytic copper foil of the present invention has opposing S side and M side. In one embodiment, the difference in roughness (Rz) of the S side and the M side is 0.5 μm or lower.

In one embodiment, the S side of the electrolytic copper foil of the present invention is a smooth surface, and the roughness (Rz) of the S side is 1.6 μm or lower.

In one embodiment, the roughness (Rz) of the M side of the electrolytic copper foil of the present invention is 1.6 μm or lower. The M side of the electrolytic copper foil of the present invention has gloss of 60 or above, when it is at a light incident angle of 60°.

In a preferred embodiment, the difference in the roughness (Rz) between the S side and the M side of the electrolytic copper foil of the present invention is 0.5 μm or lower, and the roughness (Rz) of the S side and the M side is 1.6 μm or lower. The S side and the M side both have smooth surfaces. Hence, the electrolytic copper foil of the present invention is suitable for use in a lithium ion secondary battery.

The smooth surfaces of both sides of the electrolytic copper foil of the present invention can be used as a copper foil for the negative electrode collector of a lithium ion secondary battery, after being immersed in chromic acid or subjected to surface anti-rust treatment by electroplating.

Moreover, because both sides of the electrolytic copper foil of the present invention have smooth surfaces, the electrolytic copper foil can form a very low profile (VLP) copper foil by subjecting the M side to a conventional copper roughening treatment, an alloying layer treatment and an anti-rust treatment. Because the M side of the electrolytic copper foil of the present invention does not have abnormal protruded particles, it is a glossy and smooth surface. Therefore, after the copper roughening treatment, the copper roughening-particles on the surface of the M side are uniformly distributed. The phenomenon of abnormal concentration of the copper-roughening particles due to point discharging would not occur. Thus, the copper foil is more accessible to etching, such that the copper foil is suitable for an ultra-fine line printed circuit board.

In another embodiment, the electrolytic copper foil of the present invention has a tensile strength of 45 kg/mm$^2$ or above, and preferably 45 to 60 kg/mm$^2$. The electrolytic copper foil of the present invention has a high tensile strength, such that it has excellent operability and does not generate wrinkles easily, when used in a subsequent manufacturing process. It has an elongation rate of 12% or above after a heat treatment.

The surfaces of the copper foil for a negative electrode collector of a lithium ion secondary battery are subjected to coating with a carbon material, pressing and slitting. During coating with the carbon material, the higher the tensile strength of the copper foil, the lower the likelihood of generating wrinkles. The less the wrinkles, the more uniform the coating with the carbon material. The electrolytic copper foil of the present invention has an excellent tensile strength prior to a heat treatment, such that the copper foil has an excellent operability and is not prone wrinkling in subsequent processing.

Furthermore, since the organic electrolyte in a lithium ion secondary battery contains water in excess, the degradation of the organic electrolyte would occur during charging and discharging. This causes an elevation in the internal pressure of the lithium ion secondary battery, and thereby generating hazards. Therefore, the copper foil for the negative electrode collector of a lithium ion secondary battery is assembled into a battery, only after the surfaces thereof are subjected to coating with a carbon material, pressing and slitting, and then, often a heat treatment at 140 to 150° C. for several hours to remove water from the surface of the carbon material. During the heat treatment, water can be removed from the surface of the carbon material, so as to allow recrystallization to occur in the copper foil to increase the elongation rate, and thereby preventing rupture of the copper foil due to the expansion and shrinkage of the lithium ion secondary battery during charging and discharging, to maintain the effectiveness and long term stability of the lithium ion secondary battery.

The electrolytic copper foil of the present invention has an excellent elongation rate after a heat treatment, such that the copper foil does not easily rupture whether it is being used in the negative electrode collector of a lithium ion secondary battery or on a printed circuit board.

The present invention further discloses a method for producing an electrolytic copper foil, which includes providing a hydrogen peroxide solution to a copper sulfate electrolyte, wherein 6 to 30 mL of the hydrogen peroxide solution is added to per ton of the copper sulfate electrolyte per hour, and the concentration of the hydrogen peroxide solution is 50 wt %.

In a preferred embodiment, the method further includes, prior to performing an electrochemical reaction with the improved copper sulfate electrolyte, using activated carbon to filter the improved copper sulfate electrolyte.

In the method of the present invention, the hydrogen peroxide solution is added to the copper sulfate electrolyte, so as to effectively degrade impurities like grease and organic impurities in the copper sulfate electrolyte and to enhance the effects of activated carbon filter in removing impurities, and thereby increasing the cleanliness of the copper sulfate electrolyte.

EMBODIMENTS

In the following, the specific embodiments are used to further illustrate the detailed description of the present invention. Those skilled in the art can conceive the other advantages and effects of the present invention, based on the disclosure of the specification.

Embodiment 1

Preparation of an Electrolytic Copper Foil of the Present Invention

Copper wires without pretreatments were dissolved in 50 wt % of an aqueous sulfuric acid solution to produce a copper sulfate electrolyte containing 270 g/l of copper sulfate ($CuSO_4.5H_2O$) and 100 g/l of sulfuric acid, 6 ml of hydrogen peroxide (50 wt %; manufactured by Chang Chun Petrochemical Co., Ltd.) was added per ton of the copper sulfate electrolyte per hour, and the mixture was filtered by using the activated carbon filter.

An electrolytic copper foil with a thickness of 8 μm was prepared at a liquid temperature of 42° C. and a current density of 50 A/dm$^2$. The gloss, roughness, tensile strength and elongation rate of the electrolytic copper foil of the present invention were measured, and the appearance of the M side of the electrolytic copper foil prepared in embodiment 1 was observed by using a scanning electron microscope (SEM) at 2000× magnification, as shown in FIG. 1. The electrolytic copper foil of embodiment 1 was subjected to a surface coating test with a carbon material, to observe whether wrinkles occur on the surfaces of the copper foil. Finally, the copper foil was made into a lithium ion secondary battery, which was subjected to a charging-discharging test to observe whether cracks occur on the surfaces of the copper foil.

Embodiment 2

Preparation of an Electrolytic Copper Foil of the Present Invention

Copper wires without pretreatments were dissolved in 50 wt % of an aqueous sulfuric acid solution to prepare a copper sulfate electrolyte containing 270 g/l of copper sulfate ($CuSO_4.5H_2O$) and 100 g/l of sulfuric acid, 10 ml of hydrogen peroxide (50 wt %; manufactured by Chang Chun Petrochemical Co., Ltd.) was added per ton of the copper sulfate electrolyte per hour, and the mixture was filtered by using an activated carbon filter.

Figure 2:
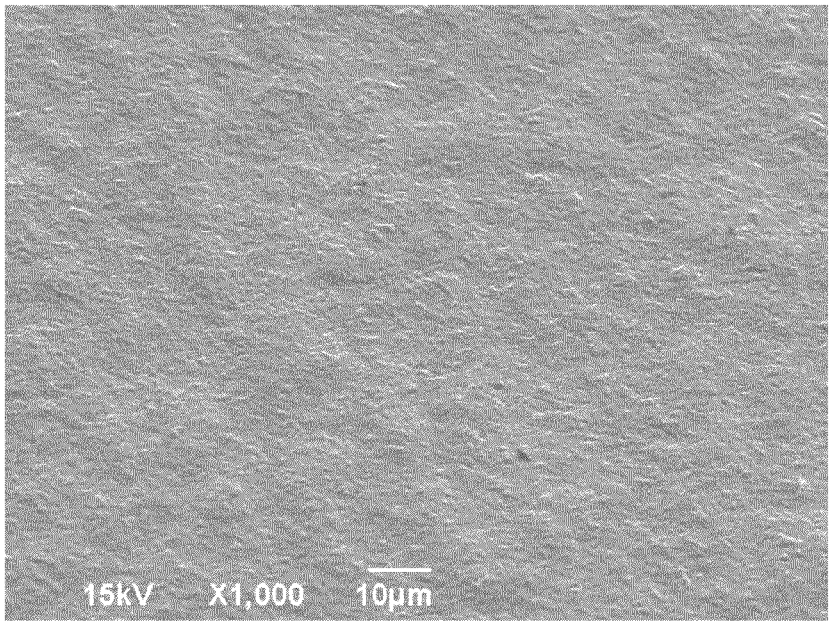
FIG. 2 is a photograph of the M side of the electrolytic copper foil of embodiment 2 of the present invention under electron microscopy at 2000× magnification.

An electrolytic copper foil with a thickness of 8 μm was prepared at a liquid temperature of 42° C. and a current density of 50 A/dm$^2$. The gloss, roughness, tensile strength and elongation rate of the electrolytic copper foil of the present invention were measured, and the appearance of the M side of the electrolytic copper foil prepared in embodiment 2 was observed by using a scanning electron microscope (SEM) at 2000× magnification, as shown in FIG. 2. The electrolytic copper foil of embodiment 2 was subjected to a surface coating test with a carbon material, to observe whether wrinkles occur on the surfaces of the copper foil. Finally, the copper foil was made into a lithium ion secondary battery, which was subjected to a charging-discharging test to observe whether cracks occur on the surfaces of the copper foil.

Embodiment 3

Preparation of an Electrolytic Copper Foil of the Present Invention

Copper wires without pretreatments were dissolved in 50 wt % of an aqueous sulfuric acid solution to prepare a copper sulfate electrolyte containing 270 g/l of copper sulfate ($CuSO_4.5H_2O$) and 100 g/l of sulfuric acid, 20 ml of hydrogen peroxide (50 wt %; manufactured by Chang Chun Petrochemical Co., Ltd.) was added per ton of the copper sulfate electrolyte per hour, and the mixture was filtered by using an activated carbon filter.

Figure 3:
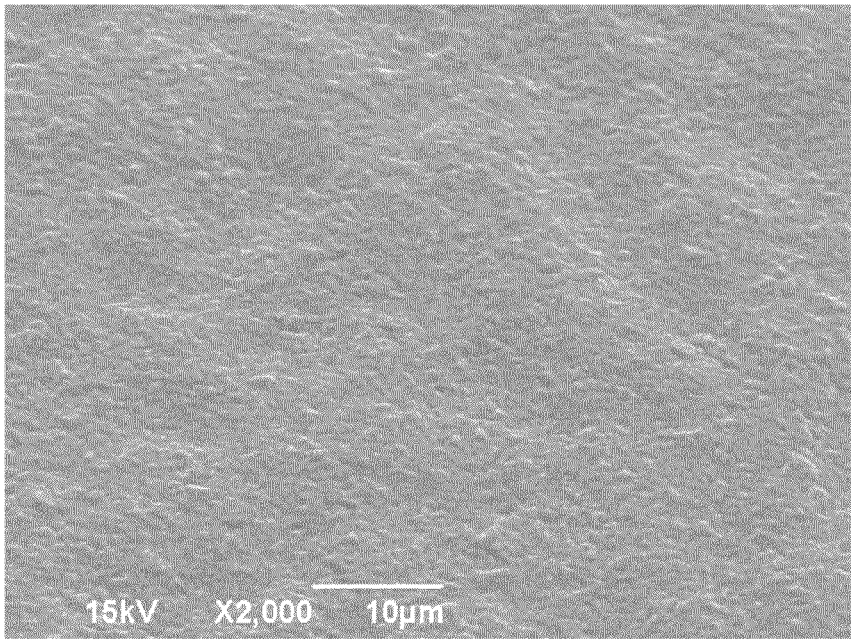
FIG. 3 is a photograph of the M side of the electrolytic copper foil of embodiment 3 of the present invention under electron microscopy at 2000× magnification.

An electrolytic copper foil with a thickness of 8 μm was prepared at a liquid temperature of 42° C. and a current density of 50 A/dm$^2$. The gloss, roughness, tensile strength and elongation rate of the electrolytic copper foil of the present invention were measured, and the appearance of the M side of the electrolytic copper foil prepared in embodiment 3 was observed by using a scanning electron microscope (SEM) at 2000× magnification, as shown in FIG. 3. The electrolytic copper foil of embodiment 3 was subjected to a surface coating test with a carbon material, to observe whether wrinkles occur on the surfaces of the copper foil. Finally, the copper foil was made into a lithium ion secondary battery, which was subjected to a charging-discharging test to observe whether cracks occur on the surfaces of the copper foil.

Embodiment 4

Preparation of an Electrolytic Copper Foil of the Present Invention

Copper wires without pretreatment were dissolved in 50 wt % of an aqueous sulfuric acid solution to prepare a copper sulfate electrolyte containing 270 g/l of copper sulfate ($CuSO_4.5H_2O$) and 100 g/l of sulfuric acid, 30 ml of hydrogen peroxide (50 wt %; manufactured by Chang Chun Petrochemical Co., Ltd.) was added per ton of the copper sulfate electrolyte per hour, and the mixture was filtered by using an activated carbon filter.

Figure 4:
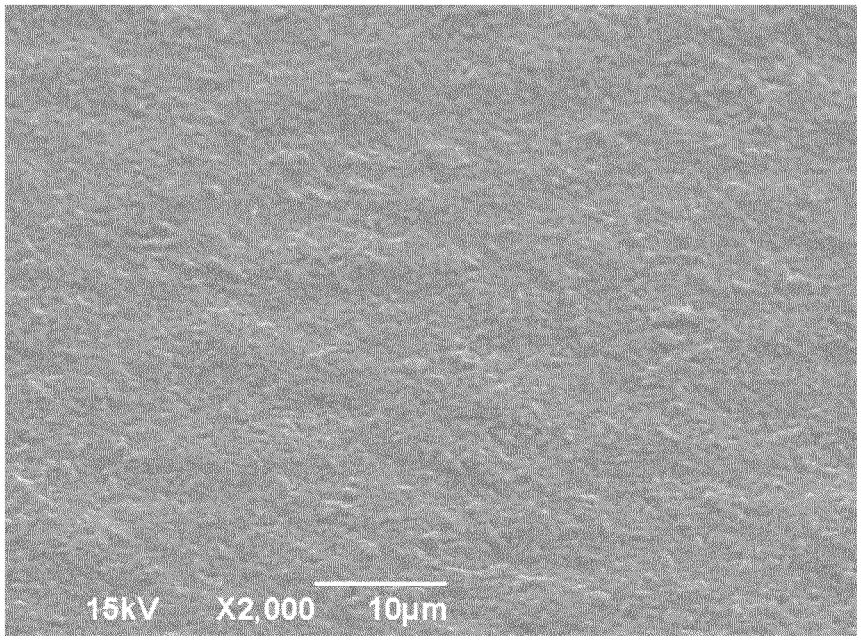
FIG. 4 is a photograph of the M side of the electrolytic copper foil of embodiment 4 of the present invention under electron microscopy at 2000× magnification.

An electrolytic copper foil with a thickness of 8 μm was prepared at a liquid temperature of 42° C. and a current density of 50 A/dm$^2$. The gloss, roughness, tensile strength and elongation rate of the electrolytic copper foil of the present invention were measured, and the appearance of the M side of the electrolytic copper foil prepared in embodiment 4 was observed by using a scanning electron microscope (SEM) at 2000× magnification, as shown in FIG. 4. The electrolytic copper foil of embodiment 4 was subjected to a surface coating test with a carbon material, to observe whether wrinkles occur on the surfaces of the copper foil. Finally, the copper foil was made into a lithium ion secondary battery, which was then subjected to a charging-discharging test to observe whether cracks occur on the sides of the copper foil.

COMPARATIVE EXAMPLES

Comparative Example 1

Preparation of a Conventional Electrolytic Copper Foil

Copper wires without pretreatments were dissolved in 50 wt % of an aqueous sulfuric acid solution to prepare a copper sulfate electrolyte containing 270 g/l of copper sulfate ($CuSO_4.5H_2O$) and 100 g/l of sulfuric acid ($H_2SO_4$).

Then, the copper sulfate electrolyte was used, and filtered by using an activated carbon filter.

Figure 5:
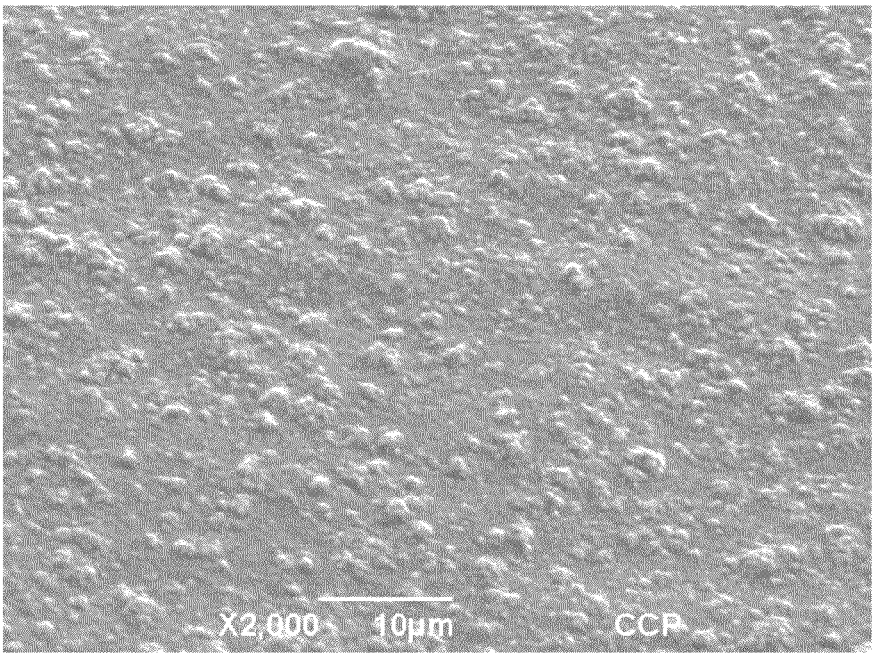
FIG. 5 is a photograph of the M side of the electrolytic copper foil of comparative example 1 under electron microscopy at 2000× magnification.

An electrolytic copper foil with a thickness of 8 μm was prepared at a liquid temperature of 42° C. and a current density of 50 A/dm$^2$. The gloss, roughness, tensile strength and elongation rate of the electrolytic copper foil of the present invention were measured, and the appearance of the M side of the electrolytic copper foil prepared in comparative example 1 was observed by using a scanning electron microscope (SEM) at 2000× magnification, as shown in FIG. 5. The electrolytic copper foil of comparative example 1 was subjected to a surface coating test with a carbon material, to observe whether wrinkles occur on the surfaces of the copper foil. Finally, the copper foil was made into a lithium ion secondary battery, which was subjected to a charging-discharging test to observe whether cracks occur on the surfaces of the copper foil.

Comparative Example 2

Preparation of an Electrolytic Copper Foil (with Insufficient Addition of Hydrogen Peroxide)

Copper wires without pretreatments were dissolved in 50 wt % of an aqueous sulfuric acid solution to prepare a copper sulfate electrolyte containing 270 g/l of copper sulfate ($CuSO_4.5H_2O$) and 100 g/l of sulfuric acid ($H_2SO_4$), 2 ml of hydrogen peroxide (50 wt %; manufactured by Chang Chun Petrochemical Co., Ltd.) was added per ton of the copper sulfate electrolyte per hour, and filtered by using an activated carbon filter.

Figure 6:
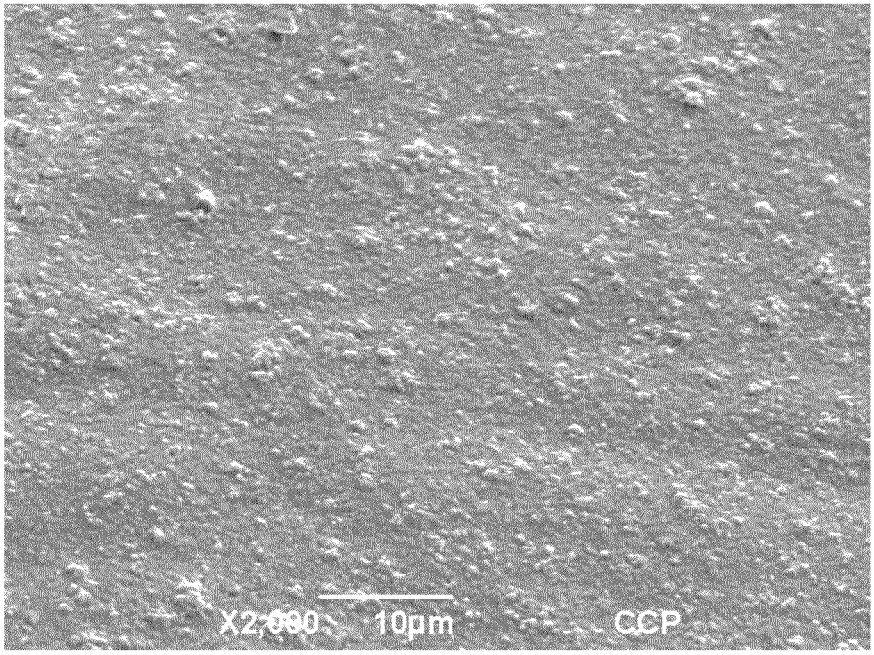
FIG. 6 is a photograph of the M side of the electrolytic copper foil of comparative example 2 under electron microscopy at 2000× magnification.

An electrolytic copper foil with a thickness of 8 μm was prepared at a liquid temperature of 42° C. and a current density of 50 A/dm$^2$. The gloss, roughness, tensile strength and elongation rate after a heat treatment of the electrolytic copper foil of the present invention were measured, and the appearance of the M side of the electrolytic copper foil prepared in comparative example 2 was observed by using a scanning electron microscope (SEM), at 2000× magnification, as shown in FIG. 6. The electrolytic copper foil of comparative example 2 was subjected to a coating test was with a carbon material, to observe whether wrinkles occur on the surfaces of the copper foil. Finally, the copper foil was made into a lithium ion secondary battery, which was subjected to a charging-discharging test to observe whether cracks occur on the surfaces of the copper foil.

The electrolytic copper foils prepared in the above embodiments 1 to 4 and comparative examples 1 and 2 were trimmed to test samples with appropriate sizes. The test samples were visually observed for presence or absence of gloss, and measured for their tensile strengths, elongation rates, roughness and gloss, and subjected to a battery charging-discharging test after being coated with carbon materials. The analytic methods used in the test examples are described in details below.

Gloss Test:

A gloss meter (manufactured by BYK Company; Model No. micro-gloss 60° type) was used by the JIS Z8741 method, i.e., by measuring the gloss in the machine direction (MD) at a light incident angle of 60°.

Roughness (average roughness of ten points, Rz):

Measurements were performed by using an α-type surface roughness meter (manufactured by Kosaka Laboratory Ltd.; Model No. SE 1700) and the IPC-TM-650 method.

Tensile Strength and Elongation Rate:

The electrolytic copper foil was trimmed into test strips with the size of 100 mm×12.7 mm (length×width). According to the IPC-TM-650 method, an AG-I tensile strength tester (manufactured by Shimadzu Corporation) was used to analyze the test strips under the condition of a chuck distance of 50 mm and a crosshead speed of 50 mm/min at room temperature (about 25° C.).

Elongation Rate After a Heat Treatment:

The electrolytic copper foil was baked at 140° C. for 5 hours. The electrolytic copper foil was trimmed into test strips with the size of 100 mm×12.7 mm (length×width). According to the IPC-TM-650 method, an AG-I tensile strength tester manufactured by Shimadzu Corporation was used to analyze the test strips under the condition of a chuck distance of 50 mm and a crosshead speed of 50 mm/min at room temperature (about 25° C.).

Coating Test with Carbon Material:

First, a carbon material slurry was prepared based on a negative material formulation. Based on the total weight of the carbon material slurry, the negative material formulation includes 95 wt % of a cathode active material (Mesophase Graphite Powder Anode; MGPA), 1 wt % of a conductive agent (i.e., conductive carbon powder, Super P), 1.6 wt % of hydroxymethyl cellulose (CMC) thickener and 2.4 wt % of aqueous styrene-butadiene rubber (SBR) binder. After the components of the negative material formulation were mixed, the carbon material slurry was coated on the surfaces of copper foil at a speed of 5 meters per minute to a thickness of 130 μm. The copper foil was observed for the occurrence of wrinkles.

Charging-Discharging Test on a Battery

Preparation of a Lithium Ion Secondary Battery

N-methyl-2-pyrrolidone (NMP) was used as a solvent for a positive material (at a solid to liquid ratio of 195 wt % (100 g of the positive material: 195 g of NMP)) as shown in table 1, so as to obtain a positive slurry. Water was used as a solvent for a negative material (at a solid to liquid ratio of 73 wt % (100 g of the negative material: 73 g of water)), so as to obtain a negative slurry.

Then, the positive slurry was coated on aluminum foil, and the negative slurry was coated on the electrolytic copper foils prepared in embodiments 1 to 4 and comparative examples 1 and 2. After the solvents evaporated, the electrolytic copper foils were pressed and slitted into certain sizes to form positive and negative electrodes.

Before the positive and negative electrodes were assembled into a battery, baked the negative electrode in an oven at 140° C. for 5 hours to remove moisture from the surface of the negative material, and allow re-crystallization to occur in the electrolytic copper foil to increase the elongation rate of the electrolytic copper foil. Afterwards, a positive electrode, two separators (manufactured by Celgard Company), and a negative electrode were winded together, and placed in a container. Filled the container with an electrolyte, and sealed the container to form a battery. The specification of the battery is Battery Cylinder Type 18650.

The electrolyte was prepared by adding 1M of lithium hexafluorophosphate ($LiPF_6$) and 2 wt % of vinylene carbonate (VC) to a mixed solution of ethylene carbonate (EC) and ethyl methyl carbonate at a volume ratio of 1:2. The lithium ion secondary batteries prepared using the electrolytic copper foils of embodiments 1 to 4 and comparative examples 1 and 2 were subjected to the charging-discharging test.

TABLE 1

| Positive material formulation: | Based on the total weight of the positive material |
|---|---|
| Positive active substance ($LiCoO_2$) | 89 wt % |
| Conductive agent (Flaked graphite; KS6) | 5 wt % |
| Conductive agent (Conductive carbon powder; Super P) | 1 wt % |
| Binder (PVDF1300) | 5 wt % |
| **Negative material formulation:** | **Based on the total weight of the negative material** |
| Negative active substance (MGPA) | 95 wt % |
| Conductive agent (Conductive carbon powder; Super P) | 1 wt % |
| Thickener (CMC) | 1.6 wt % |
| Aqueous binder (SBR) | 2.4 wt % |

Charging-Discharging Test:

The lithium ion secondary batteries prepared using the electrolytic copper foil of embodiments 1 to 4 and comparative examples 1 and 2 were repeatedly charged and discharged for 300 times. Then, the lithium ion secondary batteries were disassembled, to observe whether cracks occurred in the copper foils. The charging mode was the constant current-constant voltage (CCCV) mode, the charging voltage was 4.2V, and the charging current was 1 C. The discharging mode was the constant current (CC) mode, the discharging voltage was 2.8V, and the discharging current was 1 C. The charging-discharging test on the batteries were conducted at room temperature (at 25° C.).

TABLE 2

Results of the measurements of the properties of the electrolytic copper foil

| | Embodiment 1 | Embodiment 2 | Embodiment 3 | Embodiment 4 | Comparative example 1 | Comparative example 2 |
|---|---|---|---|---|---|---|
| Tensile strength ($kg/mm^2$) | 48.5 | 53.2 | 57.6 | 56.9 | 39.8 | 40.2 |
| Elongation rate (%) | 3.7 | 4.2 | 5.4 | 5.3 | 3.1 | 3.3 |
| Elongation rate after the heat treatment at 140° C. for 5 hours (%) | 12.8 | 14.3 | 15.6 | 15.4 | 9.2 | 9.6 |
| Roughness (Rz) at S side (μm) | 1.08 | 1.06 | 1.09 | 1.07 | 1.06 | 1.09 |
| Roughness (Rz) at M side (μm) | 1.53 | 1.37 | 1.32 | 1.34 | 2.12 | 1.96 |
| Difference in roughness (Rz) between S side and M side (μm) | 0.45 | 0.31 | 0.23 | 0.27 | 1.06 | 0.87 |
| Gloss of M side in MD direction (Gs60°) | 68 | 72 | 82 | 80 | 35 | 43 |
| Visual observation of M side | ○ | ○ | ○ | ○ | x | x |
| Whether wrinkles were generated on the copper foil after the coating test with a carbon material | No | No | No | No | Wrinkles were generated at the boundary of the carbon material and the copper foil | Wrinkles were generated at the boundary of the carbon material and the copper foil |

TABLE 2-continued

| Results of the measurements of the properties of the electrolytic copper foil | | | | | | |
|---|---|---|---|---|---|---|
| | Embodiment 1 | Embodiment 2 | Embodiment 3 | Embodiment 4 | Comparative example 1 | Comparative example 2 |
| Whether cracks were generated on the copper foil after the charging-discharging test | No | No | No | No | Cracks generated | Cracks generated |

○: Visually observed gloss in the appearance
x: Visually observed no gloss in the appearance As shown in FIGS. 1 to 6, the addition of hydrogen peroxide in the copper sulfate electrolytes could lower the roughness of the M sides of the electrolytic copper foils, and could even lower the occurrence of the abnormal protruded particles on the M sides. As hydrogen peroxide was not added to the copper sulfate electrolyte of comparative example 1, abnormal protruded particles were found on the M side, and the difference in roughness between the S side and the M side was significant and the tensile strength was lower. After being subjected to coating with a negative carbon material slurry, wrinkles were generated at the boundary of the carbon material and the copper foil. Further, after being subjected to the heat treatment at 140° C. for 5 hours, the elongation rate was lower, such that the copper foil generated cracks after the battery was subjected to the charging-discharging test.

In addition, the results in Table 2 show that the process for producing an electrolytic copper foil of the present invention is simple, and does not have safety concerns. The electrolytic copper foil of the present invention has a high tensile strength, the roughness of the S side and M side thereof are both low, and the difference in roughness between the S side and the M side are extremely small. Further, after being coated with a negative carbon material slurry, the electrolytic copper foil does not generate wrinkles. After being subjected to a heat treatment at 140° C. for 5 hours, the electrolytic copper foil has an excellent elongation rate. After a lithium ion secondary battery is subjected to a charging-discharging test, the electrolytic copper foil does not generate cracks, and is capable of maintaining the life of the lithium ion secondary battery.

The above examples are only used to illustrate the principle of the present invention and the effect thereof, and should not be construed as to limit the present invention. The above examples can all be modified and altered by those skilled in the art, without departing from the spirit and scope of the present invention as defined in the following appended claims.

What is claimed is:

1. An electrolytic copper foil comprising:
a shiny side; and
a matte side opposing the shiny side, the matte side has a roughness (Rz) of not more than 1.6 μm;
wherein the shiny side and matte side have a difference in roughness, the difference in roughness being 0.45 nm or less, and the electrolytic copper foil has a tensile strength of 45 kg/mm$^2$ or above, wherein the matte side of the electrolytic copper foil has a gloss of 60 or above at a light incidence angle of 60°.

2. The electrolytic copper foil of claim 1, wherein the electrolytic copper foil has an elongation rate of at least 12% measured after a heat treatment is performed on the electrolytic copper foil at 140° C. for 5 hours.

3. The electrolytic copper foil of claim 1, wherein the shiny side of the electrolytic copper foil has roughness (Rz) of 1.6 μm or less.

4. The electrolytic copper foil of claim 1, wherein the matte side of the electrolytic copper foil has roughness (Rz) of 1.32-1.56 μm.

5. The electrolytic copper foil of claim 4, wherein the shiny side of the electrolytic copper foil has a surface roughness (Rz) of at least 1.06 μm.

6. The electrolytic copper foil of claim 1, wherein the copper foil has a tensile strength in the range of 45-60 kg/mm$^2$.

7. The electrolytic copper foil of claim 1, wherein the shiny side of the electrolytic copper foil has a surface roughness (Rz) of at least 1.06 μm.

8. An electrolytic copper foil comprising:
a shiny side; and
a matte side opposing to the shiny side, the matte side has a roughness (Rz) of not more than 1.6 μm;
wherein the shiny side and the matte side have a difference in roughness, the difference in roughness being 0.45 μm or less, and the electrolytic copper foil has a tensile strength of 45 kg/mm$^2$ or above, wherein the electrolytic copper foil has a thickness of 8 μm.

9. An electrolytic copper foil comprising:
a shiny side; and
a matte side opposing to the shiny side; the matte side of the electrolytic copper foil has a gloss of 60 or above in the machine direction at a light incidence angle of 60°, and the matte side has a roughness (Rz) of not more than 1.6 μm;
wherein the shiny side and the matte side have a difference in roughness, the difference being 0.45 μm or less, and the electrolytic copper foil has a tensile strength of 45 kg/mm$^2$ or above.

10. The electrolytic copper foil of claim 9, wherein the shiny side of the electrolytic copper foil has a surface roughness (Rz) of at least 1.06 μm.

11. An electrolytic copper foil comprising:
a shiny side; and
a matte side opposing to the shiny side; the matte side of the electrolytic copper foil has a gloss of 60 or above at a light incidence angle of 60°, and the matte side has a roughness (Rz) of not more than 1.6 μm;
wherein the shiny side and the matte side have a difference in roughness, the difference in roughness being 0.45 μm or less; and
the electrolytic copper foil has a tensile strength in the range of 45-60 kg/mm$^2$; and
wherein the electrolytic copper foil has an elongation rate of at least 12% after a heat treatment is performed on the electrolytic copper foil at 140° C. for 5 hours.

12. The electrolytic copper foil of claim 11, wherein the copper foil has a thickness of 8 μm.

* * * * *